US006505104B2

(12) United States Patent
Collins

(10) Patent No.: US 6,505,104 B2
(45) Date of Patent: Jan. 7, 2003

(54) ROUTING METHOD AND SYSTEM FOR RAILWAY BRAKE CONTROL DEVICES

(76) Inventor: Jonathan Collins, 1400 Gest St., Cincinnati, OH (US) 45203

( * ) Notice: Subject to any disclaimer, the term of this patent is extended or adjusted under 35 U.S.C. 154(b) by 0 days.

(21) Appl. No.: 09/826,836

(22) Filed: Apr. 6, 2001

(65) Prior Publication Data

US 2002/0004693 A1 Jan. 10, 2002

Related U.S. Application Data

(60) Provisional application No. 60/216,686, filed on Jul. 7, 2000.

(51) Int. Cl.[7] ..... G06F 17/00
(52) U.S. Cl. ..... 701/19; 246/167 R
(58) Field of Search ..... 701/19; 340/988; 246/62, 167 R

(56) References Cited

U.S. PATENT DOCUMENTS 4,582,280 A * 4/1986 Nichols et al. ..... 105/61
4,794,548 A 12/1988 Lynch et al.
4,847,770 A 7/1989 Kane et al.
4,912,471 A 3/1990 Tyburske et al.
5,185,700 A 2/1993 Bezos et al.
5,374,015 A * 12/1994 Bezos et al. ..... 246/169 R
5,533,695 A 7/1996 Heggestad et al.
5,554,982 A 9/1996 Shirkey et al.
RE35,590 E 8/1997 Bezos et al.
5,686,888 A * 11/1997 Welles et al. ..... 340/3.31
5,719,771 A 2/1998 Buck et al.
5,740,046 A 4/1998 Elestedt
5,757,291 A 5/1998 Kull
5,785,283 A 7/1998 Ehrenberger et al.
5,786,998 A 7/1998 Neeson et al.
5,803,411 A 9/1998 Ackerman et al.
5,831,519 A 11/1998 Pedersen et al.
5,836,529 A 11/1998 Gibbs
5,867,801 A 2/1999 Denny
5,902,341 A 5/1999 Wilson
6,263,265 B1 * 7/2001 Fera ..... 246/122 R
6,322,025 B1 * 11/2001 Colbert et al. ..... 246/167 R

* cited by examiner

*Primary Examiner*—Michael J. Zanelli
(74) *Attorney, Agent, or Firm*—Dykema Gossett, PLLC

(57) ABSTRACT

A system, method and apparatus for detecting the content of communications between Head of Train and End of Train devices to display and record same, and employ same to route End of Train devices back to a desired location.

11 Claims, 6 Drawing Sheets

| A | B | C | D | E | F |
|---|---|---|---|---|---|
| EOT # | MOV | BRAKE PRESSURE | BATTERY VOLTS | COMMENTS | EVENT TIME |
| 4657 | | 88 | 12.2 | HOT 2481 REQUESTING LINK | 20:44:30 |

250 252 254 256 258 260

ROUTING METHOD AND SYSTEM FOR RAILWAY BRAKE CONTROL DEVICES

CROSS-REFERENCE TO RELATED APPLICATION

This application incorporates and claims priority of U.S. Provisional Application Serial No. 60/216,686, filed Jul. 7, 2000, entitled EOT Tracking Smart Super Scanner.

BACKGROUND OF THE INVENTION

1. Field of the Invention

This invention relates to monitoring the radio transmissions of railway End of Train devices and Head of Train devices, and more particularly, monitoring such transmissions for verifying communication links therebetween, identifying particular devices, and tracking the locations and routing the destinations of such devices.

2. Discussion of Related Art

Individual railway vehicles commonly have a brake line that runs from one end of the vehicle to the other. The process of assembling a train includes coupling these individual brake lines together to form a continuous brake line running from one end of the train to the other. Air pressure introduced into this brake line activates the brakes on each of the individual vehicles. Air pressure within the brake line above a threshold pressure causes the brakes on a vehicle to release. When pressure in the brake line falls below a threshold value, the brakes default into an applied state.

To insure the integrity of the brake line and proper operation of the brakes, the air pressure in the brake line is monitored at both the forward and at the rear end of the train. A Head of Train (HOT) device mounted on a locomotive monitors the brake line pressure at the front end of the train. An End of Train (EOT) device that is removably mounted near the rear coupling of the last car of the train monitors the brake line pressure at the rear end of the train.

The EOT device is equipped with a valve that is connected to an end of the brake line. The valve, when opened, releases compressed air from the brake line, thus permitting the brakes of each car to assume the default braking state. The HOT displays EOT status information. The HOT also provides control for an emergency valve in the EOT device.

The HOT unit communicates with the EOT unit, typically over Ultra-High Frequency (UHF) or Very-High Frequency (VHF) radio channels, as part of an end of train monitoring system. Radio tranceivers in the HOT and EOT devices are adapted to transmit operational messages to the other device. These messages allow for testing of the devices, control of the EOT device by the HOT device, and the transmission of status information from the EOT device to the HOT. Operating personnel may review or record the information.

Each EOT device is provided with a unique identification number that is fixed at the time of its manufacture. The HOT device typically includes a microprocessor and memory along with a user interface through which an operator stationed at the HOT device can enter, for example, the identification code for a particular EOT device mounted at the far end of the same train.

Once a HOT device has been programmed with the EOT identification number and communication between the HOT and designated EOT have been established, the HOT communicates exclusively with that EOT device. Communication between the HOT and the EOT devices take place on an ongoing basis during normal operation of the train.

To establish communication between the HOT and EOT devices, a link must be established therebetween. This link is initialized by a multi-stage communication "handshake" designed to assure reliable and exclusive communication. The success of this handshake or "link" is critically important to the safe operation of the train. Accordingly, monitoring the linking process while assembling a train would be very useful.

Most railroad organizations regularly rely on EOT devices for the safety of their trains. The EOT devices are attached to trains that typically travel across the tracks of two or more different railroad companies. Normally, when a train carrying the EOT device of one company reaches a destination within the rail network of another company, the EOT device is removed and replaced by an EOT belonging to the company of the network being traversed. The removed EOT then is returned to the owner of the EOT. However, operational and scheduling constraints, make it impractical to remove and replace the EOT at the first stop within a new network. Consequently, EOT devices regularly are loaned or rented between railroad organizations. The rental fees, although not unduly high, can grow substantially when an EOT device becomes "lost" or cannot readily be returned to its owner. Likewise, failing to properly record the return of EOT devices can result in an EOT being deemed "lost" with like consequences in terms of accumulated rental fees. Accordingly, it would be beneficial to have a system that could locate EOT devices and automatically provide a message including return instructions including a destination address, to railway personnel at each successive stop made by the EOT bearing train.

Various HOT and EOT communication devices have been proposed. For example, a known automated initial terminal testing system tests the air pressure and leakage of brake lines and the operation of the brakes of railroad trains, and discloses the use of a central control console to monitor both the HOT and EOT devices on each track in the yard and remotely control the HOT devices. Another device, positioned at the wayside of a railway system, detects and transmits information about defects to be transmitted from the wayside to the train for display in the locomotive. The existing user interface of a modified HOT device is proposed as the means for display of information thus transmitted. A known mobile communications package is capable of responding to Query for Health reports with data for keeping an inventory of on-board equipment.

None of the foregoing disclose the various useful and novel aspects of the present invention, nor would they serve to meet the objectives of this invention disclosed within.

SUMMARY OF THE INVENTION

In view of the above, the invention provides for ready monitoring and troubleshooting of the linking process, by independently accessing the HOT-EOT communications channel. The invention also ensures the return of EOT devices to their owners.

The invention also provides for a network and database to provide EOT devices with return messages to ensure timely return of the EOT devices to their rightful owners.

The invention is a method and a system for monitoring the ongoing communications between HOT and EOT devices, and sending radio signal messages that may be received and operated on by an unmodified EOT or HOT device, for routing EOT devices back to their owners.

The invention monitors the linking procedure executed by the HOT and EOT devices for establishing radio communications therebetween, and to confirm whether the linking procedure is successful or unsuccessful.

The present invention troubleshoots suspect communication links to ascertain the device responsible for a perceived link failure.

The invention monitors the broadcasts of the EOT device and records the identification and status information contained therein.

The invention identifies the presence of foreign EOT devices on trains operating within a rail system, notifies appropriate railway personnel of the need to replace the foreign EOT device with a company EOT device, and provides railway personnel with address and procedural information related to the foreign EOT device.

The invention locates within a foreign railway systems non-company EOT devices, indicated by independent records to be on loan to the company.

The invention identifies company EOT devices operating on foreign railway systems to assume their ultimate return.

These and other advantages of the invention will become apparent to those of skill in the art from the following drawings and description which illustrate some non-limiting embodiments of the invention.

BRIEF DESCRIPTION OF THE DRAWINGS

The invention is described below in view of the following drawings in which similar reference characters denote corresponding features consistently, wherein.

DETAILED DESCRIPTION OF THE PREFERRED EMBODIMENTS

In operation, wayside monitoring units are placed at various locations across the rail system. The resulting network of wayside monitoring units collects and supplies information regarding outbound trains (i.e. trains leaving the railway network of the company) to a central computer over a communication link, preferably a telephone connection. A central computer then analyzes the information provided by the wayside monitoring units, along with information collected from other wayside monitoring units along the route. The data then are sent to the next wayside monitoring unit at a point along the train's route, and a record of the location of the EOT device is maintained in a database. The database contains records about the location of every EOT device under company control. Within a short time, the location of substantially all EOT devices within the company rail system may be known.

Figure 1:
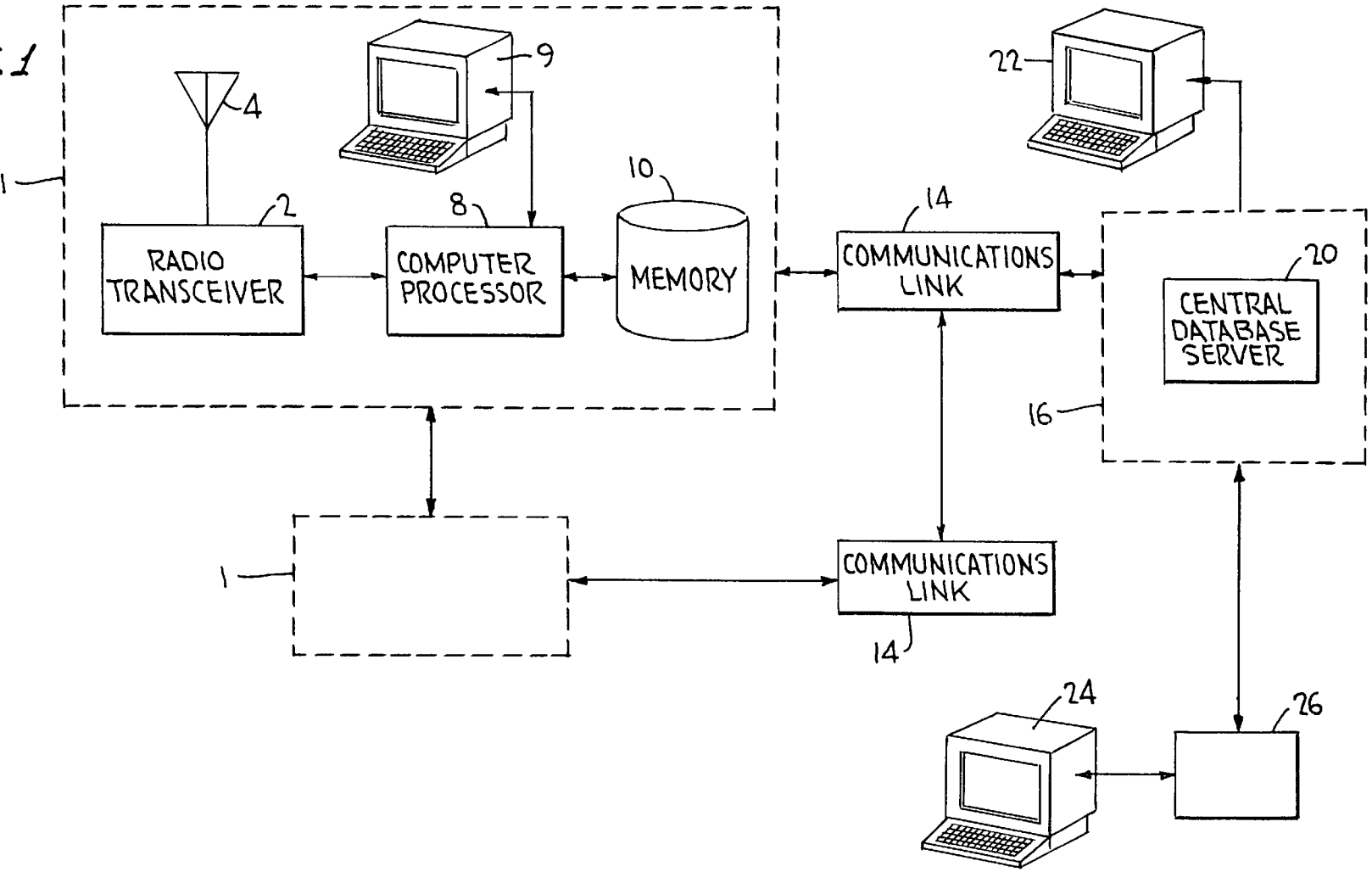
FIG. 1 is a block diagram of a monitoring system for railway brake control devices according to the invention.

FIG. 1 shows a block diagram of a system for monitoring HOT and EOT devices. System has two basic components: a wayside monitoring unit 1, for monitoring radio transmissions between HOT and EOT devices, and a central unit 16, for receiving, processing, distribution and storing information received from wayside monitoring unit 1. In practice, multiple wayside monitoring units 1 provide information to central unit 16.

Wayside monitoring unit 1 includes a radio transceiver 2 provided with an antenna 4 operatively connected to a computer processor 8 which is further operatively connected to a memory 10. Computer processor 8 also may be connected to a local user interface device 9. Local user interfacing is particularly desirable when wayside monitoring unit 1 is configured to be portable. Computer processor 8 is operatively connected to a communications link 14, such as, for example, a telephone line, a cellular phone transceiver, an optical cable, an Internet connection, or a microwave link.

Central unit 16 includes a central database server 20 having a central processing unit (not shown), memory (not shown), and ancillary devices as necessary to support the maintenance of a database of information. A plurality of computers, configured, for example, as a network, may function as central unit 16. Central database server 20 further is operatively connected to a user interface 22 and to such other computers (not shown) and data sources (not shown) as may provide scheduling information related to various trains. Central unit 16 stores deployment information related to the identification, location, destination and ownership of EOT devices on monitored trains, and return instructions therefor. Central unit 16 correlates and distributes identification and return information received from various sources with an EOT identification code to various remote user interfaces 24 by means of additional communication links 26.

As mentioned above, establishing a communication link between an HOT and an EOT requires a predefined linking sequence of radio transmissions. These transmissions contain messages encoded, for example, in DTMF or rs-232 format, for interpretation by modem circuitry within the HOT and EOT devices.

Figure 2A:
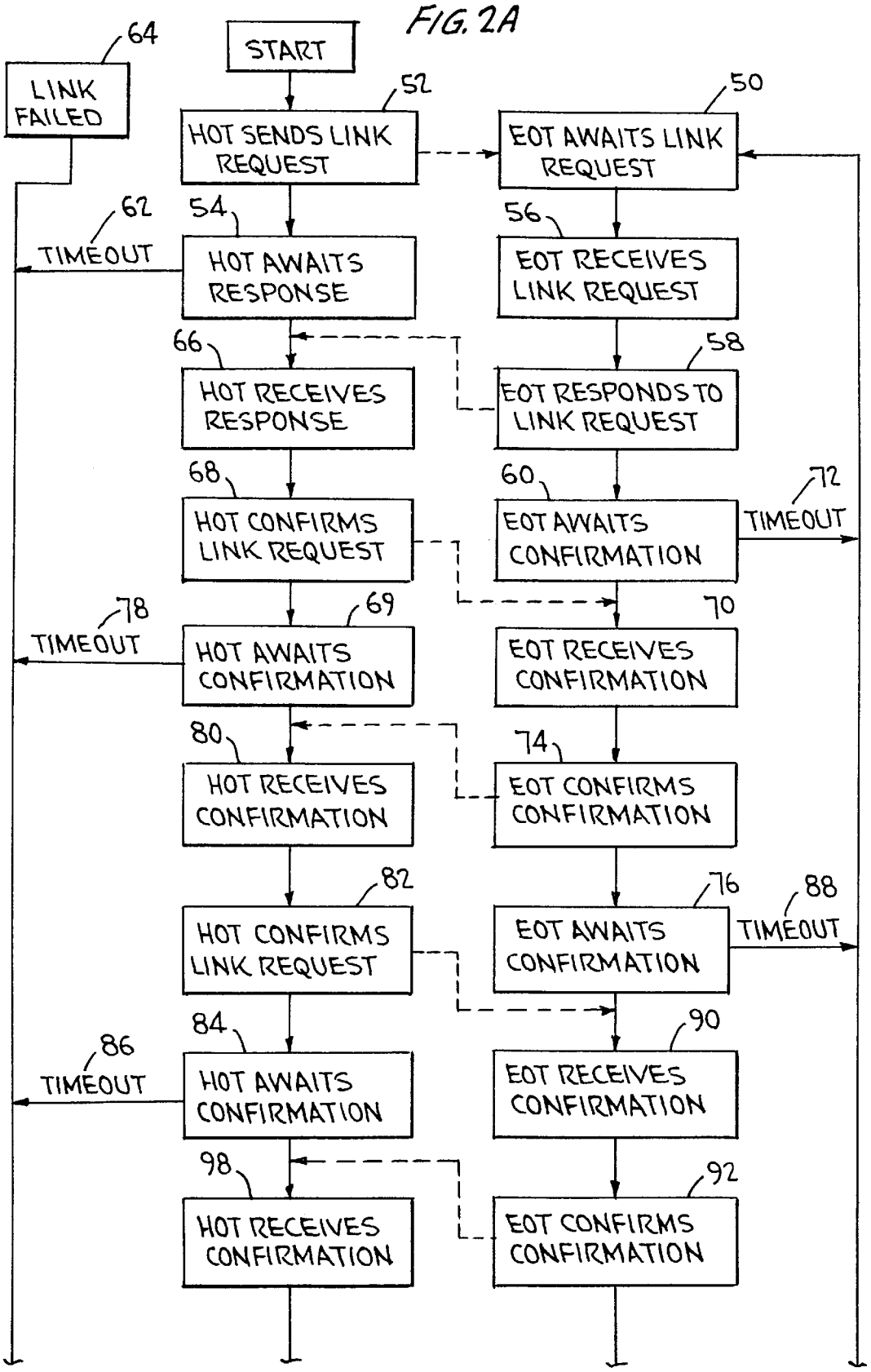
FIG. 2 is a finite state diagram of a linking process between a Head of Train and an End of Train device according to the invention.
Figure 2B:
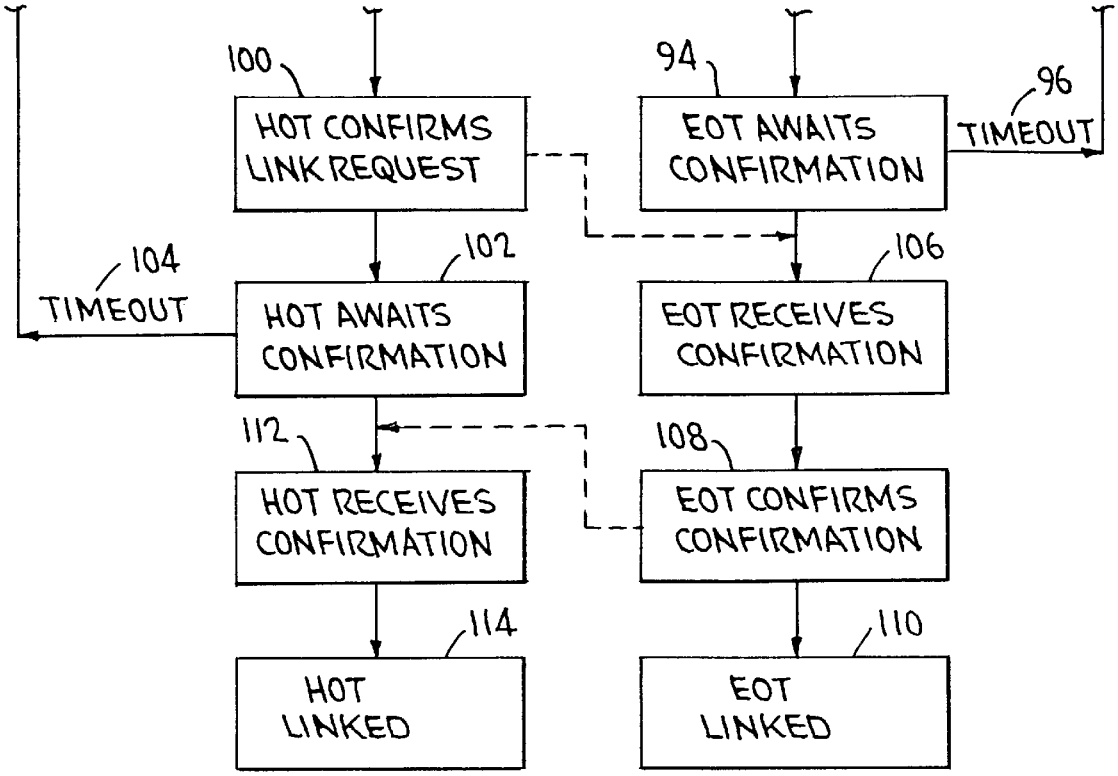

FIG. 2 shows an abbreviated finite state machine representation of the handshake executed by the HOT and EOT devices to complete a link therebetween. At step 50, prior to linking, the EOT device waits indefinitely for a link request. At step 52, the linking operation begins when the HOT sends a link request to an EOT. At step 54, after sending the link request, the HOT waits for a response. At step 56, the EOT device receives the link request. At step 58, the EOT responds to the link request, then, at step 60, waits for confirmation.

If the EOT response is delayed such that the HOT device triggers a time out, at step 62, then, at step 64, the link fails. If, on the other hand, at step 58, the EOT responds and, at step 66, the response is received by the HOT prior to timeout, at step 62, then, at step 68, the HOT sends a message that confirms the link request to the EOT and, at step 69, waits for confirmation.

At step 70, the EOT receives this confirmation message unless, at step 72, a timeout occurs. Then, at step 76, the EOT confirms the confirmation and, at step 76, waits for the HOT to confirm.

If the EOT times out, at step 72, the hot returns to step 50 and begins another indefinite wait for a new link request. Assuming no timeout occurs and the EOT confirms confirmation, at step 74, prior to the occurrence of a HOT timeout, at step 78, then, at step 80, the HOT receives confirmation and, at step 82, again confirms the link request. The HOT then awaits confirmation, subject to a possible timeout, at step 86. The EOT, which awaits confirmation, at step 76, subject to timeout, at step 88, receives confirmation, at step 90, which, at step 92, the EOT confirms. Thereafter, at step 94, the EOT awaits confirmation, subject to timeout, at step 96. At step 98, the HOT receives confirmation and, at step 100, confirms the link request for a third time. Thereafter, at step 102, the HOT awaits confirmation, subject to timeout, at step 104. At step 106, the EOT receives confirmation and, at step 108, again confirms confirmation. At step 110, the EOT pends indefinitely in a linked state. At step 108, the EOT transmits confirmation which, at step 112, the HOT receives. At step 114, the HOT enters a hot linked state, where it pends indefinitely. Thus, the HOT and EOT maintain a linked state.

HOT and EOT devices periodically reestablish the link, which avails wayside monitoring unit 1 of the opportunity to monitor EOT HOT transmissions.

Figure 3A:
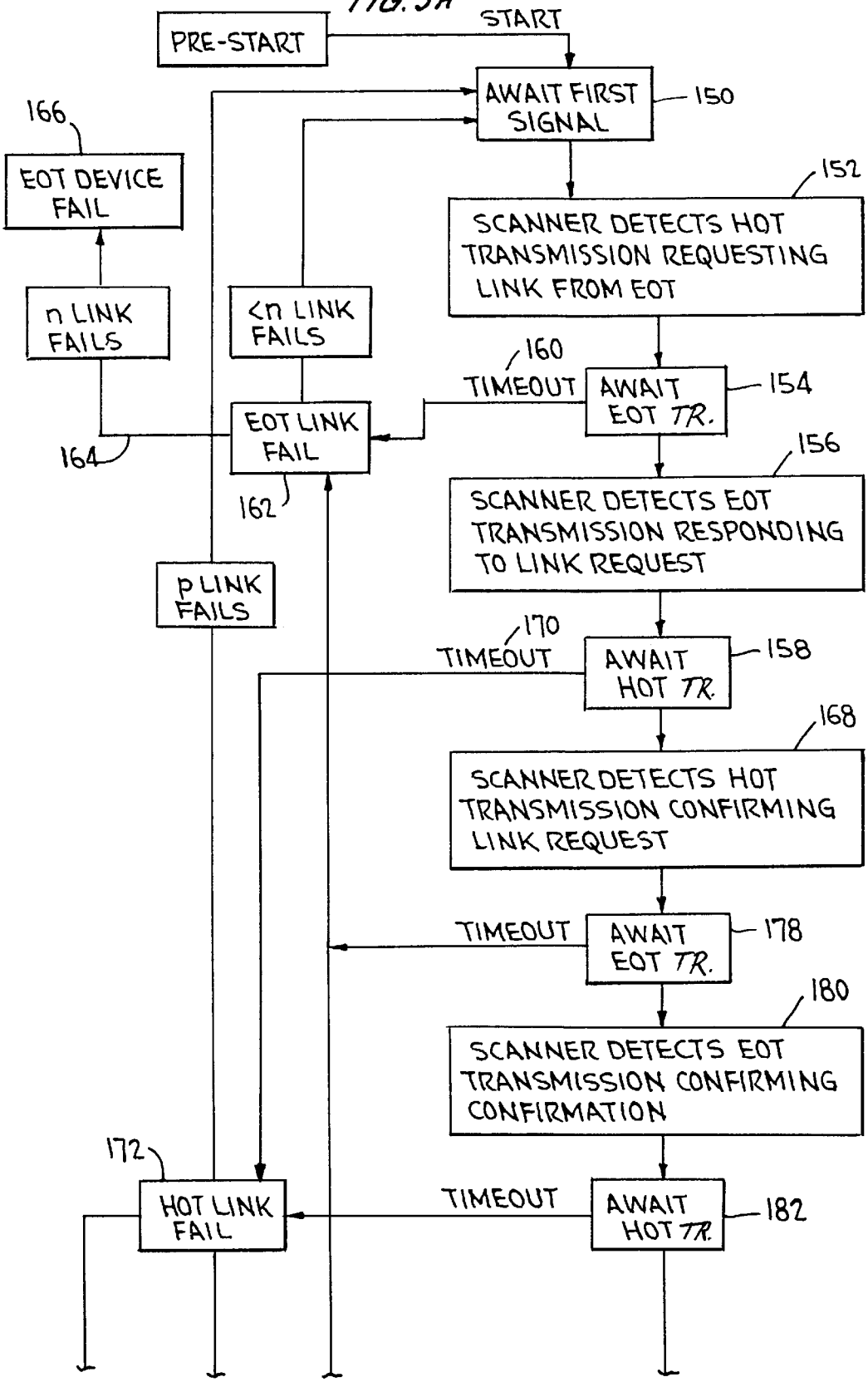
FIG. 3 is a finite state diagram of a link monitoring process undertaken by a wayside monitoring unit of the invention.
Figure 3B:
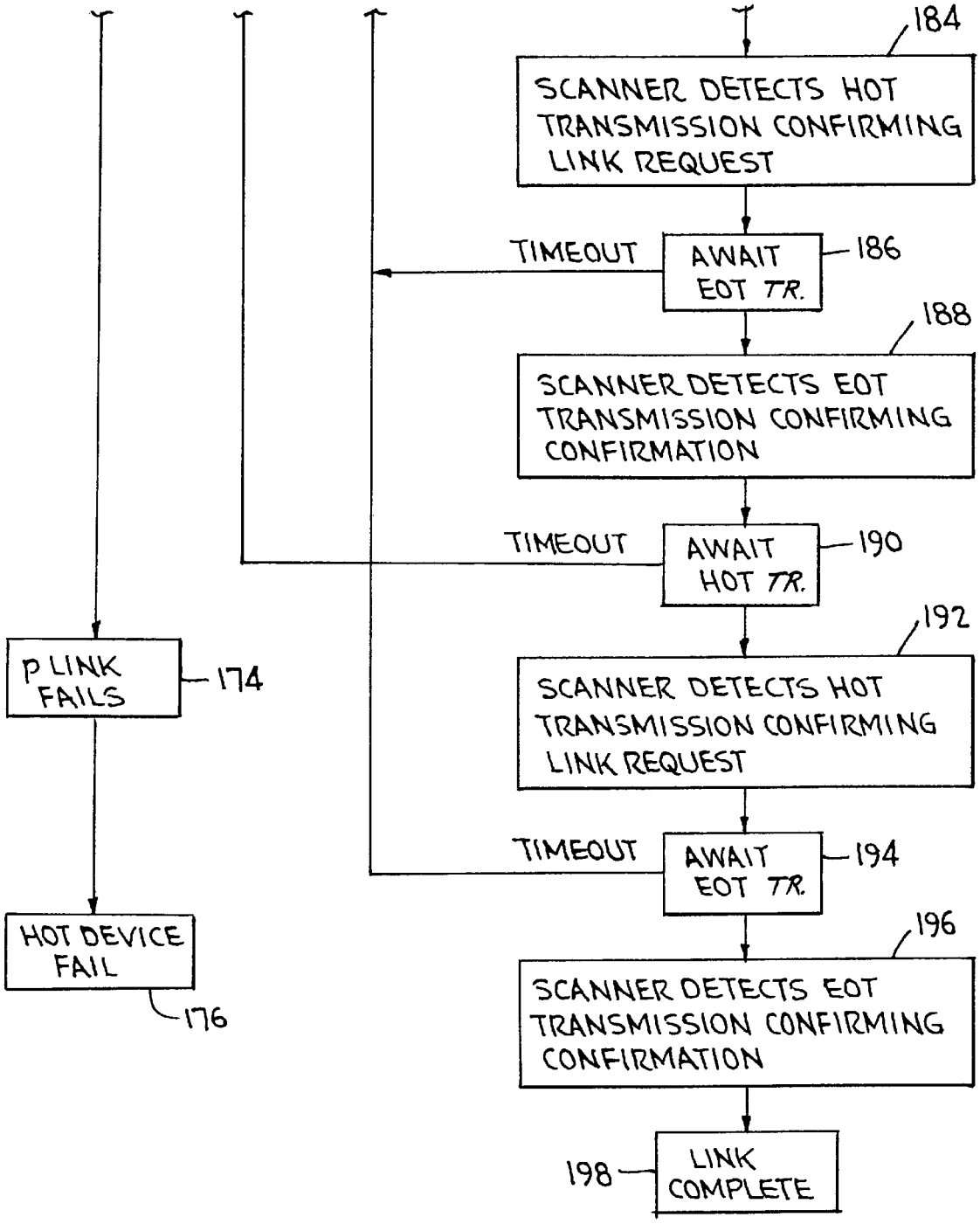

Referring to FIG. 3, wayside monitoring unit 1 is programmed to progress through a finite sequence of states while monitoring the radio correspondence between HOT and EOT devices. At step 150, on activation of a link monitoring function, wayside monitoring unit 1 waits for a first radio signal from a HOT device bearing the identification code and requesting a link from an EOT. At step 152, when the first radio signal is detected, at step 154, wayside monitoring unit 1 begins waiting for a responsive signal from the EOT. At step 156, if a signal message indicates that a signal originates from an EOT of the correct identification code responsive to a link request prior to the expiration of a pre-programmed time limit, then, at step 158, wayside monitoring unit 1 begins waiting for a confirming the link request message from the HOT. However, if, at step 160, the time limit expires prior to receipt of a properly identified response from the EOT, then, at step 162, wayside monitoring unit 1 recognizes an EOT link failure. This failure may be recorded and indicated on, for example, local user interface device 9, as shown in FIG. 1.

Initially, a link failure causes wayside monitoring unit 1 to resume waiting for an HOT link request, at step 150. However, at step 164, after a pre-established number of link failures, at step 166, wayside monitoring unit 1 determines that the EOT device has failed, and, accordingly, indicates this status via network communications and/or local display.

Assuming that, at step 156, wayside monitoring unit 1 detects the EOT transmission responding to a link request, and no time-out occurs, at step 160, then, at step 158, wayside monitoring unit 1 proceeds to wait for an HOT transmission confirming the link request transmitted, at step 168, again subject to a timeout limitation, at step 170.

A timeout while waiting for a message to originate from a HOT device also results in a link-failed condition, at step 172, however, with respect to the HOT device. Processing returns to step 150, where wayside monitoring unit 1 waits for an HOT request for link transmission, or, at step 174, after a finite number of retries, passes to step 176, where wayside monitoring unit 1 determines that the HOT device has failed.

At step 168, successful detection of an HOT transmission confirming the link request causes wayside monitoring unit 1 to wait, at step 178, for an EOT transmission confirming confirmation transmittal, transmitted at step 180. At step 182, the detection of the EOT transmission confirming confirmation causes wayside monitoring unit 1 to wait for an HOT fan transmission confirming the link request transmitted, at step 184. At step 186, following reception of the transmission confirming the link request, wayside monitoring unit 1 begins waiting for a further EOT transmission confirming confirmation, transmitted at step 18. At step 190, following receipt of the confirming confirmation message, the EOT awaits a further HOT message confirming link request. At step 194, following receipt of this further confirming link request message, at step 192, wayside monitoring unit 1 waits for yet another EOT transmission confirming confirmation. Finally, at step 196, receipt of the EOT confirming confirmation message causes wayside monitoring unit 1 to recognize, record and indicate successful completion of a link, at step 198.

One of ordinary skill in the art appreciates that alternative embodiments may obtain the stated objectives. For example, the invention may be configured to monitor and store all communications, including the identification code of the EOT, and then analyze the content of the stored messages after a finite period elapses or a finite number of messages are received, or after message traffic abates over a particular time period.

As described above, the present linking procedure is sequential. If either the EOT or HOT fails to timely respond to a transmission of the other of the EOT and HOT in the previous link step, then a link between the EOT and HOT will not be established. Wayside monitoring unit 1 follows every link step in progress and detects if one of the devices fails to respond. If a failure occurs several times, wayside monitoring unit 1 determines that the equipment is defective and notifies the appropriate railway personnel so that a replacement device may be installed. Because a normal link procedure typically takes less than two minutes, it is possible for wayside monitoring unit 1 to identify a continuity problem in approximately that length of time.

Among the linking related defects that may be detected by the invention are when: an EOT device fails to transmit, an HOT fails to transmit, an EOT fails to respond to a link request, a HOT fails to respond to an EOT confirmation, a HOT has been provided with an EOT identification code that does not match an EOT in use, an EOT identification code has been supplied to more than one HOT device, and excessive external interference radio noise exists.

The invention also may provide troubleshooting capabilities. For example, HOT-EOT pairs may operate in different modes. One mode, standardized by the Association of American Railroads, operates over UHF broadcasting frequencies. Other proprietary modes operate over, for example, VHF broadcasting frequencies. The present invention detects whether an HOT or an EOT operates in incompatible modes.

Wayside monitoring unit 1 also can detect whether an EOT fails to transmit. This defect may not be apparent when an HOT requests a response from an EOT device, the HOT request is detected, but no EOT transmission follows. Similarly, wayside monitoring unit 1 can detect whether an HOT fails to transmit. Such defect may be identified by evaluating the transmission record data available from wayside monitoring unit 1. For example, if no link is achieved, the operator of wayside monitoring unit 1 receiving HOT and EOT messaging can review the data summarizing the link attempts to see if the HOT transmitting link request messages The invention may be configured to identify link failure causation occurring at an EOT device. An EOT device can fail to respond to a link request, despite an ability to do so, for at least two reasons. First, the EOT already may be linked to another HOT device. Second, the EOT device may be unable to decode an incoming message containing the link request from a HOT device. The invention provides for ascertaining which of these failure modes may be responsible for a link failure.

The invention also may be configured to detect a HOT device that fails to respond. For example, the HOT device may transmit a link request to the EOT and the EOT may respond, but the HOT device then may fail to register or acknowledge the EOT transmission. This condition results when a HOT device is unable to decode incoming data. The invention can identify this condition and notify appropriate personnel that the HOT device should be serviced.

The invention also may detect continuous dumping by the EOT device after the EOT device has been reset, commonly the result of a software defect in the HOT device that causes the HOT to send dump requests repetitively.

The invention also can detect operator errors. For example, when an operator enters an incorrect EOT identification number into a HOT device user interface, the HOT device may repeatedly request a link, but not with a desired EOT device. In one scenario, no link can be established. In another scenario, it is possible that two HOT devices request a link with a single EOT device. In a further scenario, an HOT device may request links with an EOT device already linked to a HOT device.

The invention also can detect excessive interference on a communication channel, caused by the presence of other equipment in the vicinity, causing the local device to is transmit incorrectly.

The invention can display the linked status of any linked HOT-EOT device pair within radio range of wayside monitoring unit 1, provided the HOT-EOT pair link activity was available to wayside monitoring unit 1 when the link was formed. However, newer models of HOT and EOT devices periodically confirm link status, thus periodically may provide link status to wayside monitoring unit 1.

The invention also tracks and issues return instructions for EOT devices. As discussed above, the geographical expanse of a railway system, in conjunction with the large number of trains that operate thereon, and, commonly, the plurality of companies that operate the trains and tracks, complicate the proper routing of EOT devices.

Figures 4, 5:
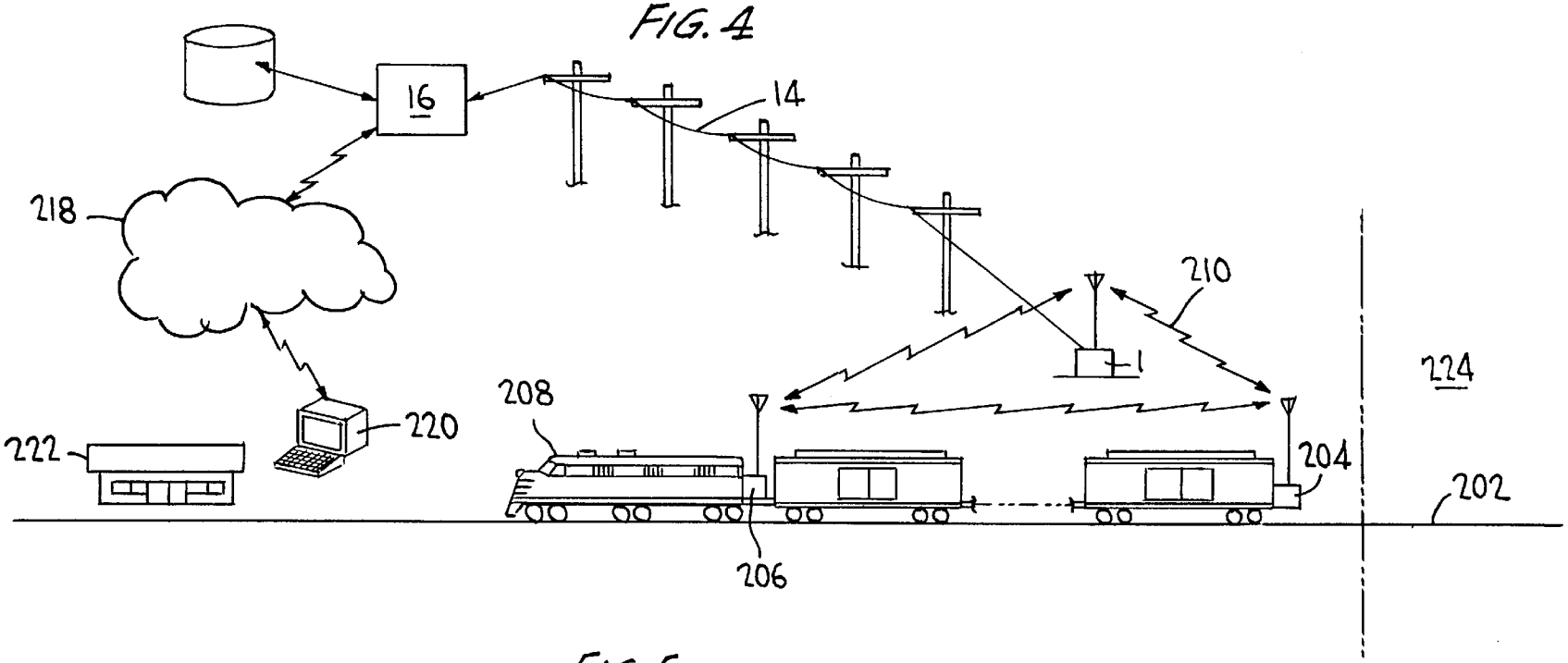
FIG. 4 is a schematic view of an apparatus for tracking an EOT device entering from a foreign system and providing return instructions to railway personnel.
FIG. 5 is a display view of data gathered by wayside monitoring unit of the invention.

Referring to FIG. 4, the invention aids in tracking and routing EOT devices by providing wayside monitoring unit 1, as described above, temporarily or permanently, proximate to railroad tracks 202. Wayside monitoring unit 1 monitors the radio transmissions 210 between an EOT device 204 and a HOT 206 device of a passing trains 208. As discussed above, transmissions 210 include information uniquely identifying EOT 204. Either immediately or after some delay, wayside monitoring unit 1 transmits the identifying information received via a communication link 14 to central unit 16 along with information identifying the location of wayside monitoring unit 1. Central unit 16 then cross references the wayside location information and the EOT identification code with available EOT device ownership lists and train schedules. Based on the cross referencing of this information, central unit 16 generates a message containing return or redeployment instructions appropriate for EOT device 204, and transmits the message via a communication link 218, for example, a global computer network commonly referred to as the internet, to a user interface 220 accessible by railway personnel at a scheduled stop 222 of train 208.

The present invention can track a EOT device 204 even if disposed within a foreign railroad system 224. For example, wayside monitoring unit 1 may be positioned close to a foreign railroad right-of-way along a heavily traveled corridor to detect the signals emitted by EOT 204 passing nearby. Wayside monitoring unit 1 receives signals routinely transmitted by EOT device 204 and logs in the identity thereof. Wayside monitoring unit 1 periodically transmits this information back to central unit 16 via, for example, a modem and phone line connection.

Situating wayside monitoring unit 1 proximate to a heavily traveled corridor also provides for locating many other EOT devices in a short time period. Thus, a temporary installation of wayside monitoring unit 1 may survey foreign traffic sufficiently to track then route EOT devices. As the productivity of a particular temporary wayside monitoring unit diminishes, the wayside monitoring unit may be removed to other well-traveled locations.

An exemplary real-world embodiment of temporary wayside monitoring unit 1 includes a conventional personal computer located in a weather-tight enclosure within a mile from a railroad right-of-way, along with an appropriate radio receiver and a modem with conventional telephone line access or cellular telephone equipment.

In addition to tracking and providing routing information for EOT devices, the invention can provide brake line pressure readings from all HOT and EOT devices within radio range. When an in-range EOT device broadcasts a brake line pressure, wayside monitoring unit 1 logs in the value for future reference. The brake line pressure information thus logged represents the most recently received data.

Similarly, wayside monitoring unit 1 stores and can provide the most recent battery status information received from each EOT within range. This information allows service personnel to anticipate the need for battery exchanges without a request from train personnel.

The invention also provides for ascertaining from the EOT-HOT transmissions whether a train carrying the EOT-HOT pair is moving. This information assists in determining the pull time of the train.

Referring again to FIG. 1, the invention also may archive all brake test and link activity information in memory 10 for future retrieval. Ultimately, the information may be stored in central database server 20 or a comparable storage system. Brake test and link information also may be archived within the HOT which is uploadable to wayside monitoring unit 1. Consequently, information, including when each brake test was performed, whether the HOT and EOT devices were actually linked and dumped, the actual pull time of the outbound train and the time required for brake line pressure to build to operational levels, may be available for the entire history of the train following deployment of wayside monitoring unit 1.

Referring to FIG. 5, the invention is capable of capturing and displaying a variety of information extracted from the transmissions between HOT-EOT pairs. As shown in a first column 250, the last four digits of the unique identification code of an EOT device supplying data is displayed. A second column 252 contains a binary indication of when the EOT is in motion. A third column 254 displays the value of the air pressure in the brake line in pounds per square inch. A fourth column 256 displays battery voltage. A fifth column 258 displays a comment describing the status of the brake system. Finally, a sixth column 260 contains a date stamp indicating when the data were collected. The data, preferably, are stored in a file in text format, for example, as delimited ascii text.

Wayside monitoring unit 1 may transmit and receive radio transmissions on AAR and proprietary communications frequencies. Thus, wayside monitoring unit 1 may monitor and interact with any equipment within radio range on the rails.

Wayside monitoring unit 1 also may operate on a third frequency or channel which allows direct communication with various service personnel. A user having a radio with a Dual Tone Multi Frequency (DTMF) (touch tone) keypad may control wayside monitoring unit 1 by depressing a sequence of keys corresponding to an identification code for an EOT device within range. Wayside monitoring unit 1 decodes the identification code transmitted at the remote control frequency. When wayside monitoring unit 1 registers a command, wayside monitoring unit 1 may respond to the sender in a pre-recorded human voice relaying available data related to the EOT identified.

A user may elect to interact with wayside monitoring unit 1 in verbose mode. Once in verbose mode, all transmissions to or from a selected EOT device are transmitted to the requesting operator. The verbose mode may be toggled on and off, for example, by entering the identification code of the EOT device followed by a star (asterisk) key.

Since wayside monitoring unit 1 has both receiving and transmitting capabilities, wayside monitoring unit 1 can be programmed to operate as a repeater. Weak signals reaching a repeating wayside monitoring unit 1 would be detected, amplified and re-transmitted.

Wayside monitoring unit 1 may be programmed to repeat only signals originating from an EOT or HOT, not those already amplified by another repeating wayside monitoring unit 1. This may be implemented by appending control information to a transmission that countermands reamplification to once-amplified signals.

Wayside monitoring unit 1 may emulate an HOT or an EOT device for testing purposes.

Wayside monitoring unit 1 may display a time line graph for a given train showing all HOT-EOT device activity and all brake line activity.

Wayside monitoring unit 1 of the invention may download stored data from an HOT or an EOT device while the HOT or EOT device is in service.

The invention may be embodied in other specific forms without departing from the spirit or essential characteristics thereof. The present embodiments are therefore to be considered in all respects as illustrative and not restrictive, the scope of the invention being indicated by the following claims rather than the foregoing description. All changes that come within the meaning and range of equivalency of the claims are therefore intended to be embraced therein.

I claim:

1. Method of identifying EOT devices for removal by mechanical crew comprising:

providing a wayside monitoring device including a radio monitor and a microprocessor-based signal decoder;

monitoring a radio signal periodically broadcast by an EOT mounted on a passing train;

decoding the broadcast to extract an identification number identifying the EOT device;

comparing the identification number with a roster of company devices to establish ownership of the EOT device; and notifying mechanical service personnel to schedule removal of non-company devices thus identified.

2. Method of claim 1, further comprising providing return instructions for the return of said non-company EOT device to an owner company.

3. Method of routing a device mounted on a vehicle comprising:

receiving identity and deployment information pertaining to the device;

correlating the identity and deployment information with scheduling information pertaining to the vehicle; and generating a routing instruction for the device based on the identity, deployment and scheduling information.

4. Method of claim 3, further comprising ascertaining an identity of an owner of the device, wherein said generating is contingent on the identity.

5. Method of claim 3, further comprising distributing the routing instruction to a vehicle service person.

6. Method of claim 3, wherein said receiving includes transmitting and receiving radio transmissions.

7. Method of claim 3, wherein said correlating includes accessing data establishing a relationship between the device and the vehicle and data establishing a relationship between the vehicle and the scheduling information.

8. Method of claim 3, wherein the routing instruction includes an instruction to redeploy the device on another vehicle.

9. Method of claim 3, wherein the routing instruction includes a destination address for the device.

10. Method of routing an end of train (EOT) device comprising:

monitoring transmissions between the EOT device and a head of train device;

ascertaining identity and deployment information pertaining to the EOT device;

correlating the identity and deployment information with train scheduling information; and generating a routing instruction for the EOT device based on the identity, deployment and train scheduling information.

11. Method of claim 10, further comprising ascertaining an identity of an owner of the EOT device, wherein said generating is contingent on the identity.

* * * * *